United States Patent [19]

Baugh

[11] Patent Number: 4,467,996

[45] Date of Patent: Aug. 28, 1984

[54] VALVE APPARATUS

[76] Inventor: Benton F. Baugh, P.O. Box 42888 Dept 195, Houston, Tex. 77042

[21] Appl. No.: 395,616

[22] Filed: Jul. 6, 1982

[51] Int. Cl.[3] ..... E21B 33/06

[52] U.S. Cl. ..... 251/1 A; 277/127

[58] Field of Search ..... 251/1 A, 1 B, 1 R; 277/73, 127, 198, 199, 228

[56] References Cited

U.S. PATENT DOCUMENTS

| | | | |
|---|---|---|---|
| 2,912,214 | 11/1959 | Allen et al. | 277/127 |
| 3,208,357 | 9/1965 | Allen et al. | 251/1 A |
| 4,227,543 | 10/1980 | Williams, Jr. | 251/1 A |
| 4,323,256 | 4/1982 | Miyagishima et al. | 251/1 A |
| 4,398,729 | 8/1983 | Bishop et al. | 251/1 A |

*Primary Examiner*—Martin P. Schwadron

*Assistant Examiner*—Sheri Novack

*Attorney, Agent, or Firm*—Carwell & Helmreich

[57] ABSTRACT

A valve apparatus of the ram type having a pair of ram assembly bodies in opposed relation transverse to the valve bore. The ram bodies carry, in recess, respective inner seals which, upon inward movement of the ram bodies, effect sealing engagement so as to restrict flow through the valve bore. A plurality of locking pins are included disposed vertically through each seal, each such locking pin having projections extending outward of its respective seal beyond the top and bottom thereof. Each projection is matingly received by a corresponding slotted portion of the recess within and defined by said ram assembly body for restricting relative movement of said inner seal with respect to movement of its respective ram assembly body.

22 Claims, 4 Drawing Figures

VALVE APPARATUS

BACKGROUND OF THE INVENTION

Ram-type valve assemblies have long been employed in the past to control fluid flow, particularly in high pressure applications such as well blowouts and the like wherein it is necessary to effectively seal off the valve bore. Representative of such conventional valve asemblies are those depicted, for example, in Volume 1, page 978 and 980 of the "Composite Catalog of Oilfield Equipment and Services", 33rd Revision 1978–79, published by World Oil, and those depicted on page 8 and 9 of Instruction Manual No. 5/8505 entitled "Bowen Heavy Duty Blowout Preventers Hydraulic and Manual Types for Wireline and Tubing", 14th Printing, June 1979, published by Bowen Tools, Inc. In that the teachings and improvements of the present invention are particularly adaptable to the valve apparatus therein depicted and described, such disclosure is accordingly herein incorporated by reference with respect to the overall general construction and operation of such ram-type valve assemblies.

These valve assemblies frequently include two cylindrically shaped ram assemblies mounted in opposed relation and carried by a valve housing, said ram assembies having piston-shaped ram bodies being tranversely movable with respect to the bore of the housing and thus the fluid flow. Horizontally traversing the face of each ram body is a rectangular recess which is typically provided in the end portion of each ram assembly porximal to the bore. These recesses matingly receive generally rectangular block-shaped resilient sealing means having rectangular sealing faces extending slightly beyond the respective ram body face in the direction of the bore. Upon hydraulic or manual actuation of the valve assembly, the ram assemblies are caused to move inward toward the bore and one another until the aforesaid sealing faces are brought into sealing engagement with one another and with wire line, tubing, or the like (if any) disposed within the bore, so as to effectively seal the bore from further fluid flow.

The sealing means will often include metal upper and lower backup plates with a rectangularly shaped block of rubber sandwiched therebetween having the aforementioned sealing face oriented toward the bore. The thickness of the plates and rubber block are dimensioned so that the upper and lower plates are in sliding engagement along the center line of the ram assembly with respective horizontal upper and lower faces of the recess when the seal means is disposed therein.

Guide slots are provided on the outer surface of the lower plate running in the general direction of the ram assembly center line. These guide slots receive, in registry, respective tips of inner seal screws extending into the slots and carried by threaded vertical apertures within the body of the respective ram assembly.

It will thus be appreciated that relative movement of the seal means with respect to the ram body will be constrained by the length of the guide slots such that as either end of a slot contacts the tip of its respective inner seal screw disposed therein, further motion is prevented.

One serious problem associated with the design of such valve assemblies of the prior art concerns the hereinabove described manner in which the seal means are retained by the mating recess in the ram body, e.g., the guide slots and inner seal screws.

First, the inner seal screws are susceptible to working loose under vibrational and other adverse conditions often encountered, e.g., in oilfield applications, thus rendering the valve assembly inoperative. Moreover, and yet more serious, is the fact that the force behind the seal means exerted on the ram may, in some applications, exceed 15,000 lbs. Thus tremendous forces exerted between the screws and the backup plates often tend to shear the screws off. In either case, the loosened screws or sheared off portions thereof have been known to fall into the bore of the housing resulting in dangerous conditions even including, in some instances, total loss of control over oil wells and the like.

The disadvantages of the prior art including those hereinabove recited are overcome by the ram-type valve assembly apparatus of the present invention.

SUMMARY OF THE INVENTION

This invention relates to a valve apparatus of the ram type. In but one of its aspects, it relates more particularly to ram type blowout preventers having ram bodies and inner seal assemblies carried therein, and new and improved means for interconnecting same.

In a preferred embodiment, the apparatus of the present invention includes a valve body carrying two movable ram assemblies spaced in opposed relation transverse to the valve bore. Viewed from the side of each ram assembly, a generally "+" shaped horizontal recess is provided extending across the end of a piston-like cylindrical ram body thereof proximal to the bore. From the end of the ram body, this recess may be seen to extend across its face transverse to the center line of the ram body. Each recess matingly receives an inner seal assembly having a generally rectangular block-like shape and including a plurality of vertical cylindrical locking pins. Upon inward movement of the respective ram assemblies, resilient face portions of the seal assembly engage like portions of the corresponding oppositely disposed inner seal assembly (as well as drill pipe or the like disposed within the bore) in a manner so as to effectively seal off the bore. The locking pins preferably extend vertically through a rectangular block-shaped resilient seal of each inner seal assembly, each such pin exposing upper and lower end projections received by corresponding upper and lower slot portions of the recess hereinbefore described. Each inner seal assembly including the respective locking pins is thus locked into and made an integral part of the respective ram body. Moreover, sliding movement of the seal assembly relative to and along the centerline of the ram body is provided which is substantially restricted to the dimensional difference between the widths of the locking pin projections and the widths of the upper and lower recess slot portions in the direction of the ram body centerline. Shearing forces imparted to the upper and lower end portions of the locking pins by the sidewalls of the upper and lower slot portions of the recess when relative movement tends to exceed these dimensional differences is effectively resisted.

It is an object of this invention to provide a new and improved valve apparatus of the ram type.

It is another object of the present invention to provide such a valve apparatus having a new and improved ram assembly.

A further object of this invention is to provide a new and improved means for interconnecting the inner seal assembly and the ram body of a ram assembly in a ram type valve apparatus.

Yet another object of this invention is to provide for a new and improved means for interlocking and restricting relative movement of the inner seal assembly and ram body of a ram type valve apparatus which is resistant to damage from shear forces imparted thereto.

It is still a further object of the present invention to provide a novel valve assembly of the ram type having a reduced number of small parts susceptible to breakage, loss within the borehole, and the like, interconnecting the inner seal assembly and the ram body thereof.

BRIEF DESCRIPTION OF THE DRAWINGS

These and other objects and advantages are hereinafter set forth and explained in greater detail with reference to the drawings wherein.

DESCRIPTION OF THE PREFERRED EMBODIMENT

Figure 1:
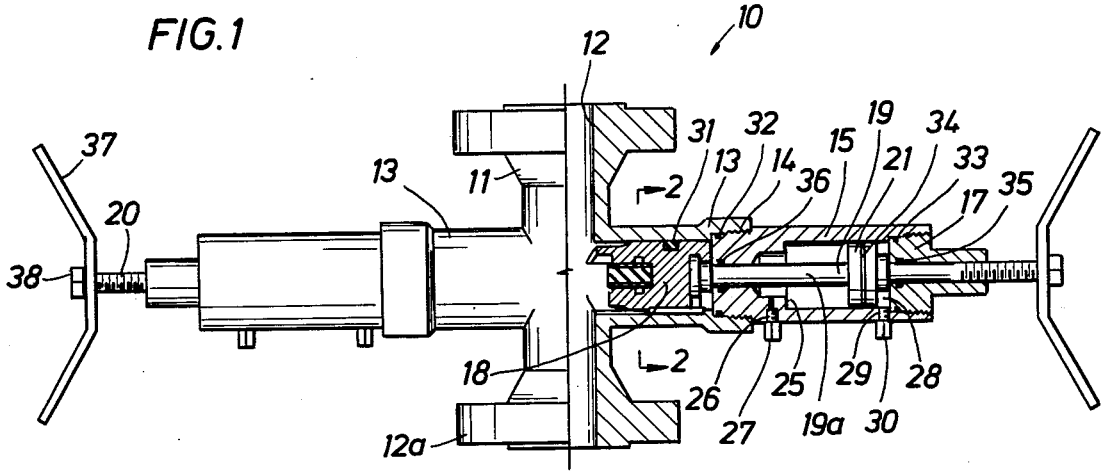
FIG. 1 is an elevation view of a valve apparatus construction in accordance with a preferred form of the present invention with the right hand portion shown in section.

Referring first to FIG. 1, a valve assembly 10 of the present invention is therein depicted having a valve body or housing 11 preferably of forged steel, a central bore 12 therethrough, and flanges 12*a* at both ends of housing 11 suitable for interconnection with pipe, tubing, or the like. Alternatively, standard threaded connections may of course by provided in lieu of the flanges 12*a*.

In the description which follows, it will be appreciated that the apparatus depicted to the left of the center line of bore 12 is identical and symmetric with respect to that shown in section to the right of the center line. Accordingly, for purposes of simplicity, description of the latter is applicable in like manner to that of the non-sectioned portion of FIG. 1.

Collar portions 13 of housing 11 are provided having collar threads 14 for threadedly receiving adapter cylinder 15. In like manner, internally threaded portions of cylinder 15 distal to bore 12 receive threaded portions of respective end caps 17. Still referring to FIG. 1, it will thus be seen that collar portion 13, adapter cylinder 15 and end cap 17 together form a cylindrical cavity tranverse to bore 12 and that a like cavity, also transverse to bore 12 in opposed spatial relation to the first mentioned cavity, is similarly formed by like components similarly arranged leftmost of the center line of bore 12.

Disposed in tandem within each cavity there may be seen in FIG. 1 a ram assembly 18, piston assembly 19, and auxiliary ram stem 20, each of which is movable in concert along the center line of said cavity in a manner to be hereinafter described in more detail.

Piston assembly 19 is preferably comprised of a shaft 19*a* which interconnects a thrust nut 22 and a piston head 21 which is disposed within a portion of the aforementioned cavity within adapter cylinder 15. This cavity portion, in turn, is comprised of an opening and closing chamber 25 and 28, respectively. A piston ring seal 34 may be provided, disposed radially about and carried by piston head 21, for preventing fluid communication between chambers 25 and 28.

Connected to opening chamber 25 and closing chamber 28 are respective opening and closing ports 26 and 29 located within the wall of adapter cylinder 15, each of which is communicated to the ambient by means of conventional hydraulic couplings 27 and 30, respectively. It may now be appreciated that upon introduction of hydraulic pressure through coupling 30, closing port 29, and into closing chamber 28, the piston head 21 will be urged from the position depicted in FIG. 1 to the left. Motive force thus imparted to piston head 21 will be transmitted through shaft 19*a* to thrust nut 22. The ram assembly 18 may be provided with a thrust plate 23 in contact with thrust nut 22 such that this force is, in turn, transmitted to ram assembly 18 which is also urged to the left along the cavity.

It will be recalled that due to the symmetry of valve assembly 10, upon like charging of closing chamber 28 in the left adapter cylinder 15 with hydraulic fluid, a similar left ram assembly 18 (not shown) which is carried within collar portion 13 will be urged to the right.

Figure 2:
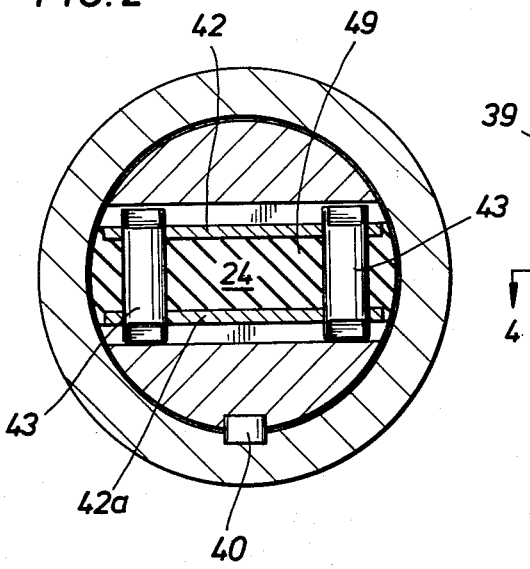
FIG. 2 is an enlarged scale elevation view of a portion of the sectioned half of the valve apparatus of the present invention depicted in FIG. 1.

Referring briefly to FIG. 2, an inner seal assembly 24, to be later described in further detail and having a resilient inner seal 49 of molded rubber or the like with a front seal face 55, is retained within a seal assembly cavity or recess 50 at the end of each ram assembly 18 proximal to the bore 12. Upon the aforementioned urging of each ram assembly 18 inward of the housing 11, seal faces 55 are brought into sealing engagement with one another and with wireline, tubing, or the like (if any) within the bore 12 so as to effect sealing off of the bore 12.

Referring again to FIG. 1, O-ring type seals 32 and 33 and an outer seal 31 (to be further described), all of which are conventionally employed, may be provided for preventing fluid within the bore 12 from leaking to the ambient or contaminating the hydraulic circuit associated with chambers 25 and 28. Similarly, O-ring seals such as 35 and stem seal 36 may be further provided to isolate the hereinbefore noted hydraulic circuit from the ambient which otherwise might result in hydraulic fluid leaking, for example, from chamber 28 along threads of ram stem 20.

Stem 20 serves at least two functions. First, it may be desired to operate valve assembly 10 manually, for example, in remote locations wherein a source of hydraulic pressure is not readily available, or in emergency conditions wherein hydraulic pressure fails. Accordingly, a stem handle 37 and handle nut 38 may be mounted on ram stem 20. It will be noted that, due to the threading of stem 20 and end cap 17, appropriate manual rotation of handle 37 will urge stem 20 inward. This, in turn, will urge piston head 21 inward as hereinbefore described, thus effecting sealing of the bore 12. Yet another function of stem 20, in addition to serving as redundancy for the hydraulic opening and closing means, is to serve as a means for maintaining the ram assembly 18 in the closed position for long periods of time when it is undesirable to maintain the closing chamber 28 in a hydraulically charged condition.

Referring now to FIG. 2, an enlarged scale cross-sectional view of the ram assembly 18 of FIG. 1 may be seen. Each ram assembly 18 is generally comprised of the previously-mentioned inner seal assembly 24, an outer seal 31, a ram key 40, cap screw 41, and ram body 44.

Referring first to the ram body 44, it is a generally cylindrical-shaped member of preferably cast or forged steel. At the distal end thereof a flat thrust plate 23 engages thrust nut 22 to transmit inward and outward movement of thrust nut 22 to ram assembly 18 as previously described.

At the end of ram body 44, there may be seen ram guides 39 which may take many forms depending upon the application, but one function of which is to ensure, for example, that any wire line within the bore 12 is guided properly into aperture 48 of inner seal assembly 24 prior to sealing engagement therewith. These ram guides 39 further ensure that upon being engaged in mating registry with a corresponding surface on the opposed ram body 44, the respective ram assemblies 18 are in proper rotational alignment with respect to one another. In yet another form depicted on page 9 of the Bowen manual cited above, for example, the ram guides 39 may be of a flattened configuration having a "V" slot proximate to and pointing outward of the bore 12, for severing the wire line within the bore 12 during inward movement of the ram assemblies 18 prior to sealing engagement of the inner seal assemblies 24.

To further prevent rotational movement of ram assemblies 18 within the cavity during inward and outward movement (which might, e.g., prevent sealing engagement of oppositely disposed front seal faces 55 of the resilient inner seal 49 of inner seal assembly 24), a rectangular key 40 is conventionally mounted by means of a cap screw 41 within a mating ram key slot **40*b* located on the lower side of ram body 44. The portion of key 40 projecting outward from ram body 44 slidably engages another ram key slot 40*a* disposed along the internal surface of collar 13 of housing 11, thus preventing undesirable rotation of ram assembly 18 relative to collar 13**.

Still referring to FIG. 2, in addition to ram key slot **40*b*, two additional recesses are provided in ram body 44, an outer seal seat 31*a* and an inner seal recess 50, the function of the latter to be described shortly. Referring more particularly to the seal seat 31*a*, it is conveniently of a uniform depth extending on the upper half of ram body 44 radially about the center line thereof in a semicircle and having shorter portions on either side of ram body 44 extending inward in the direction of bore 12 to the inner seal recess 50**.

The seal seat **31*a* is effectively a retent for a horseshoe-shaped outer seal 31 of a resilient rubber or like composition, side portions of which extend through the aforementioned shorter portions of seal seat 31*a* and contact rear seal face 55*a* portions of inner seal 49**.

When ram asemblies 18 are urged radially inward until front seal faces 55 of inner seal 49 engage with one another, further inward movement will transmit force from front seal face 55 through inner seal 49 and rear seal face **55*a* to the shortened portions of outer seal 31 in contact therewith. This force will, in turn, cause extrusion of outer seal 31 radially outward from the center line of ram assembly 18, thus effecting a fluid-tight seal about the upper half perimeter thereof between the inner wall of collar 13 and seal seat 31*a***.

Referring now in more detail to construction of the inner seal assembly 24 of the present invention, with particular reference to FIG. 2, each seal assembly 24 may be seen to be comprised of rectangularly shaped metal upper and lower backup plates 42 and **42*a*, respectively, the previously mentioned resilient inner seal 49 having front and rear sealing faces 55 and 55*a*, and a plurality of locking pins 43**.

Figure 3:
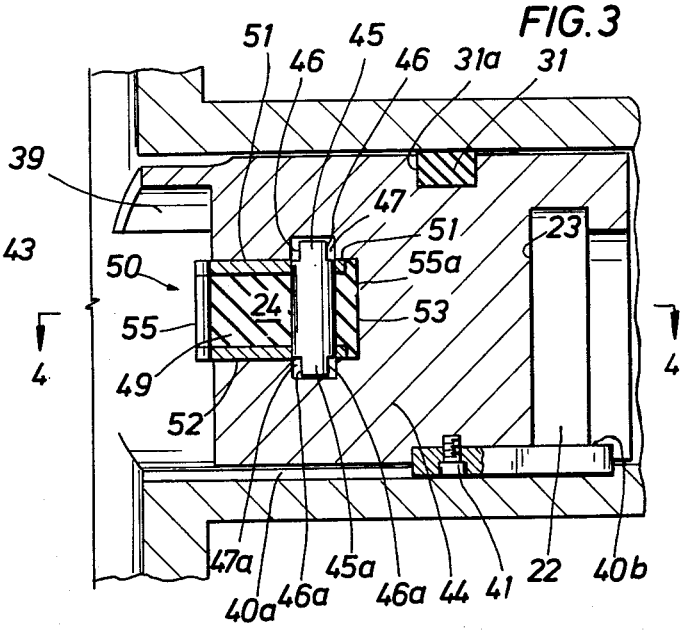
FIG. 3 is an enlarged scale cross-sectional view of the valve apparatus of the present invention taken along the line 2—2 of FIG. 1.
Figure 4:
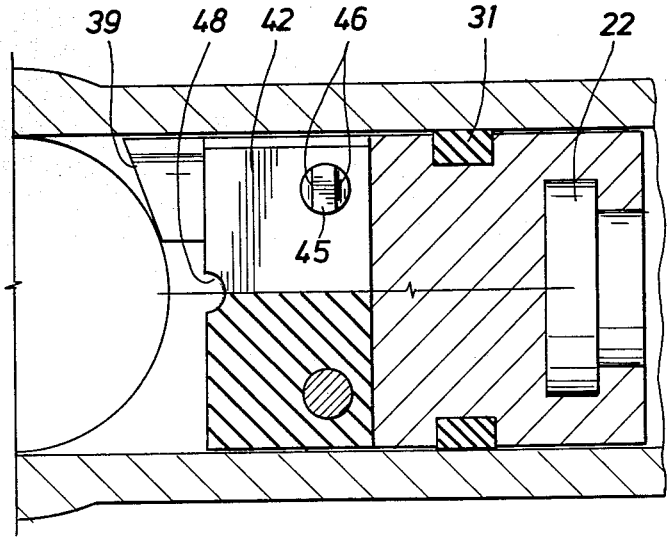
FIG. 4 is an enlarged scale plan view of the valve apparatus of the present invention taken along the line 4—4 of FIG. 3.

Inner seal 49 is a generally rectangularly shaped block of resilient sealing material which forms a 'sandwich' when disposed between backup plates 42 and **42*a*. With reference to FIGS. 2 and 3, it will be noted that two or more vertical locking pin holes may preferably be provided through the just-described assembly of backup plates 42 and 42*a* and inner seal 49 which will each receive a generally cylindrical locking pin 43. Each locking pin 43 is dimensioned so as to provide upper and lower locking pin projections 45 and 45*a* extending upwardly and downwardly beyond the surfaces of respective upper and lower backup plates 42 and 42*a*. In a preferred embodiment of the present invention, upper and lower projections 45 and 45*a* will be machined so as to provide relatively flattened respective upper and lower locking pin projection faces 46 and 46*a***.

Referring again to FIG. 2, the seal assembly recess 50, internal to the proximal end of ram body 44 will not be described in more detail. Each recess 50 will be seen from the side view of FIG. 2 to be defined by upper and lower recess faces 51 and 52 of ram body 44, a backwall recess face 53 of ram body 44, and upper and lower locking pin projection slots 47 and **47*a*, all of which are internal to ram body 44. Thus, faces 51, 52, 53, and slots 47 and 47*a* in concert form a "+" shaped recess of uniform cross-section extending across the end of each ram body 44 proximal to bore 12**.

From the foregoing description of inner seal assembly 24 and seal recess 50, it should now be apparent that seal assembly 24 may be inserted into recess 50 to form the apparatus of the present invention depicted in FIGS. 1–4. This may be accomplished by aligning pin projections 45 and **45*a* in registry with mating pin projection slots 47 and 47*a* and faces of upper and lower backup plates 42 and 42*a* with corresponding upper and lower faces 51 and 52 of recess 50. As one edge of inner seal assembly 24 is thereafter moved laterally across the ram body face 54 of ram body 44, the seal recess 50 will be seen to receive and retain in mating engagement inner seal assembly 24. It will further be noted that when ram assembly 18 is thereafter disposed within collar 13, inner seal assembly 24 will be prevented from further lateral movement by the internal wall of collar 13. Moreover, it will be noted that inner assembly 24 will thus be retained within recess 50 and slidably movable therewithin toward or away from bore 12 until upper and lower locking pin faces 46 and 46*a* of upper and lower locking pin projections 45 and 45*a* contact either the front or rear faces of their respective locking pin projection slots 47 and 47*a***.

It will be recalled that in the prior art it was conventional to provide two parallel slots along the lower face of lower backup plate **42*a* in the general direction of the center line of ram assembly 18. Inner seal screws were disposed vertically upward through threaded holes extending upward from the lower outer wall of ram body 44 through the lower face 52 of ram recess 50. Tip portions of these screws extended into their respective slots on the lower faces of the lower backup plate 42*a*. Thus, these screw tip portions performed similar guiding functions of locking pin projections 45 and 45*a* as did their mating slots in like manner to locking pin projection slots 47 and 47*a***.

However, as also previously noted, due to the relative motion of the inner seal assembly 24 with respect to the ram body 44 in the sealing and opening operations of ram assembly 18, tremendous shearing forces tended to shear off or otherwise loosen these screws. Thus not only could the screws or screw tips be lost into the bore 12, but the inner seal assembly 24 itself was no longer mechanically prevented for further movement into the bore 12, all of which could result in dangerous conditions including loss of control of a well, for example.

Thus, in comparison to the prior art, it will be appreciated that the present invention provides an inner seal assembly which is easier to assemble, has fewer small parts, and yet at the same time affords improved structural integrity properties including resistance to shearing forces and the like.

It is therefore apparent that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape and materials as well as in the details of the illustrated constructions without departing from the scope and spirit thereof.

What is claimed is:

1. A valve assembly for regulating fluid flow, comprising:

a housing having a bore disposed in the direction of a vertical bore center line and further having two cavities intersecting said bore laterally from opposite sides of said bore along a cavity center line perpendicular to said bore center line;

a pair of ram assemblies each slidably disposed in one of said cavities and including a ram body having a wall disposed about said cavity center line and a recess in one end thereof proximal to said bore extending internally through said body to opposite sides of said wall about and along a third line perpendicular to said bore center line and said cavity center line, said recess having a plurality of first cross-sections of a substantially uniform cross-shape, each of said cross-sections being formed by intersection with said recess of a corresponding different one of a plurality of planes lying along and perpendicular to said third line;

a seal means carried by said body;

a locking means for slidably retaining said seal means at least partially within said recess; and means for moving said ram assemblies along said cavity center line whereby sealing engagement within said bore of said seal means of each said ram assembly is effected.

2. The apparatus of claim 1, wherein each of said plurality of first cross-sections is substantially cross-shaped.

3. The apparatus of claim 2, wherein each of said first cross-sections is further defined by a first and a second rectangle each lying and intersecting in a corresponding one of said plurality of planes.

4. The apparatus of claim 3, wherein the longest dimension of said first rectangular is parallel to said cavity center line and the longest dimension of said second rectangular is parallel to said bore center line.

5. The apparatus of claim 4, wherein intersection of ones of said plurality of planes with said seal means and said locking means when disposed in assembly within said recess forms second cross-sections of said seal means and said locking means having substantially the same shape as said first cross-sections.

6. In a ram-type blowout preventer or the like having a central bore and opposed cavities intersecting said bore, a ram assembly disposable in said cavities, comprising:

a ram body having a recess;

a seal means received by said recess; and a locking means disposed within said recess and carried with said seal means for retaining said seal means at least partially within said recess and for restricting relative movement between said body and said seal means to within preselected limits and in directions generally parallel to said cavities.

7. The apparatus of claim 6, wherein said recess includes a projection slot and said locking means includes a projection means extending outward of said seal means and received by said slot for abutting engagement therewith.

8. The apparatus of claim 7, wherein said locking means and said seal means are interconnected to prevent substantial relative movement therebetween in said directions of said restricted relative movement between said body and said seal means.

9. The apparatus of claim 6, wherein said locking means is carried with said seal means during said relative movement between said body and said seal means.

10. The apparatus of claim 8, wherein said slot has first and second slot faces in opposed relation lying in planes perpendicular to said relative movement between said body and said seal means, the distance between and perpendicular to said faces defining a slot width;

said projection means has a projection width perpendicular to said planes less than said slot width; and relative movement of said projection means relative to said body is restricted to between said first and second slot faces and comprises the difference between said slot width and said projection width.

11. The apparatus of claim 7, wherein said locking means includes:

a locking pin having said projection means disposed at one end thereof; and wherein said seal means defines an aperture extending therethrough matingly receiving said pin in alignment generally parallel to said bore for disposing said projection means in said slot.

12. The apparatus of claim 10, wherein said projection includes first and second projection faces lying in planes parallel to said first and second slot faces for abutting engagement with respective ones of said first and second slot faces.

13. In a ram-type blowout preventer having a housing with a central bore therethrough about a vertical bore center line and two cavities oppositely disposed in said housing extending outward of said bore along a cavity center line perpendicular to said bore, a ram assembly for use in said cavities comprising:

a ram body having an internal recess proximal to said bore and defining a body wall disposed about said cavity center line;

said internal recess extending transversely through said ram body to opposite sides of said wall to form a substantially cross-shaped first cross-section when viewed in the direction of a third line perpendicular to said cavity center line and said bore center line, said recess including upper and lower projection slots;

a seal assembly having an upper and a lower backup plate, a resilient seal disposed between said upper and lower plates, and first and second apertures extending vertically parallel to said bore center line through said plates and said seal; and first and second locking pin means disposed in registry with respective said first and second apertures, each said first and second locking pin means having an upper and a lower projection extending outward of respective said upper and lower plates, said upper and lower locking pin projections being received by respective said upper and lower projection slots of said recess, for slidably retaining said seal assembly in said recess and for restricting relative movement between said seal assembly and said ram body along said cavity center line within preselected limits.

14. The apparatus of claim 13, wherein said first and second apertures are disposed along and perpendicular to said third line.

15. The apparatus of claim 14, wherein said upper and lower projection slots are parallel to said third line and extend to said opposite sides of said wall.

16. The apparatus of claim 15, wherein said seal assembly and said first and second locking pin means, when disposed in said recess, define a second cross-section when viewed along said third line which is substantially similar to said first cross-section whereby, as said seal assembly and said first and second locking pin means are first introduced into said recess and thereafter moved in the direction of said third line thereby further disposing said seal assembly and said first and second locking pin means within said recess, said recess slidably and matingly receives in registry said seal assembly and said first and second locking pin means.

17. The apparatus of claim 16, wherein said preselected limits are defined by abutting engagement of said upper and lower projection slots with respective said upper and lower projections of said first and second locking pin means.

18. The apparatus of claim 13, wherein when said first and second locking pin means are disposed in registry with respective said first and second apertures, said first and second locking pin means and said seal are slidably and matingly receivable by said recess when moved transversely to said body and into said recess in the direction of said third line.

19. In a ram-type blowout preventer or the like having a central bore and opposed cavities intersecting said bore, a ram assembly disposable in said cavities, comprising:

a ram body having a recess;

a seal means received by said recess; and a locking means disposed within said recess and carried with said seal means for retaining said seal means at least partially within said recess and for restricting relative movement between said body and said seal means to within preselected limits, wherein said bore defines a bore center line;

said cavities define a cavity center line perpendicular to said bore;

said ram body includes an outer wall disposed about said cavity center line, and wherein said recess extends internally through said ram body to opposite sides of said wall and in a direction perpendicular to said cavity center line and said bore center line.

20. In a ram-type blowout preventer or the like having a central bore and opposed cavities intersecting said bore, a ram assembly disposable in said cavities, comprising:

a ram body having a recess;

a seal means received by said recess; and a locking means disposed within said recess and carried with said seal means for retaining said seal means at least partially within said recess, said locking means comprising two locking pins disposed through said seal means and having first and second projections within said recess extending outward of said seal means on opposite sides thereof.

21. In a ram-type blowout preventer or the like having a central bore and opposed cavities intersecting said bore, a ram assembly disposable in said cavities, comprising:

a ram body;

a seal means; and a locking means extending outwards of said seal means, said ram body defining a recess into which said seal means and said locking means may be slidably inserted while in assembly whereby motion of said seal means and said locking means in assembly relative to said ram body and in the direction of said cavities is restricted to a predetermined distance.

22. In a ram-type blowout preventer having a central bore, opposed cavities intersecting said bore, and a ram assembly disposable in said cavities comprised of a ram body having a recess and a seal disposed therein, an improved seal assembly for use in said preventer comprising:

a seal means; and at least one locking means extending outwards of said seal means;

said seal means and said locking means being slidably insertable while in assembly into said recess whereby said locking pin means restricts motion of said seal means and said locking means relative to said body in the direction of said cavity to a predetermined distance.

* * * * *